US009578910B2

(12) United States Patent
Strauβ

(10) Patent No.: US 9,578,910 B2
(45) Date of Patent: Feb. 28, 2017

(54) PROTECTIVE ELEMENT

(71) Applicant: Andreas Stihl AG & Co. KG, Waiblingen (DE)

(72) Inventor: Petra Strauβ, Waldstetten (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 47 days.

(21) Appl. No.: 14/465,874

(22) Filed: Aug. 22, 2014

(65) Prior Publication Data

US 2015/0059044 A1 Mar. 5, 2015

(30) Foreign Application Priority Data

Aug. 30, 2013 (EP) ..... 13004295

(51) Int. Cl.
*B32B 3/10* (2006.01)
*A41D 31/00* (2006.01)
*A41D 1/06* (2006.01)

(52) U.S. Cl.
CPC ..... *A41D 31/0061* (2013.01); *A41D 1/06* (2013.01); *A41D 31/0016* (2013.01); *A41D 2600/20* (2013.01); *Y10T 428/24802* (2015.01)

(58) Field of Classification Search
None
See application file for complete search history.

(56) References Cited

U.S. PATENT DOCUMENTS

| | | | | |
|---|---|---|---|---|
| 8,745,765 | B1 * | 6/2014 | Ahlborn | A41D 31/0055 2/22 |
| 2009/0210990 | A1 * | 8/2009 | Taylor | A41D 13/0543 2/22 |
| 2012/0079639 | A1 * | 4/2012 | Hughes | A41D 13/043 2/2.5 |
| 2015/0059045 | A1 * | 3/2015 | Supper | A41D 13/065 2/24 |

FOREIGN PATENT DOCUMENTS

| | | | |
|---|---|---|---|
| DE | 200 04 654 | U1 | 7/2000 |
| DE | 100 36 488 | A1 | 2/2002 |
| GB | 2 226 943 | A | 7/1990 |

* cited by examiner

*Primary Examiner* — Christopher Polley
(74) *Attorney, Agent, or Firm* — Gudrun E. Huckett

(57) ABSTRACT

A protective element is provided with a flat first material layer of a low-fold material and a flat second material layer of a folded cut-retardant material. A surface area of the second material layer in a stretched-out state is 1.2 to 2.5 times greater than a surface area of the first material layer in a stretched-out state. The second material layer is placed in a gathered state onto the first material layer. The first material layer forms a gliding layer for the second material layer.

22 Claims, 3 Drawing Sheets

PROTECTIVE ELEMENT

BACKGROUND OF THE INVENTION

The invention relates to a protective element comprising at least two flat material layers which are used as an insert in a protective element or in protective clothing.

When operating hand-guided power tools such as hedge trimmers, the cutting teeth may damage the clothing of the user in case of improper power tool handling. For safety reasons, it is therefore recommended that the user wear protective clothing with cut-retardant function.

When operating hedge trimmers, the cutting blades of the cutter bar perform a complex movement sequence and thereby clamp and cut the object to be cut, for example, branches and twigs of a hedge or the like, so that finally the object is cut through. When in operation the moving cutting blades contact protective clothing, the cutting blades of the cutter bar are blocked by a cut-retardant insert so that cutting through the protective clothing is substantially prevented. Under unfavorable conditions, however, fabric layers that are underneath the cut-retardant protective material may be gripped and damaged during blockage of the cutting blades.

The object of the invention is therefore to configure a protective element of the aforementioned kind such that, while a high wearing comfort is provided, seizing or gripping of a fabric layer that is underneath the protective element is prevented upon engagement of the cutting blade.

SUMMARY OF THE INVENTION

In accordance with the present invention, this is achieved in that the protective element, in particular for use when working with a hedge trimmer, is comprised of at least two flat material layers wherein the first material layer is comprised of a low-fold material and the second material layer is comprised of a folded cut-retardant material, wherein the surface area of the second material layer in the stretched-out state is 1.2 to 2.5 times greater than the surface area of the first material layer in the stretched-out state, and wherein the second material layer is gathered or draped on the first material layer, wherein the first material layer forms a gliding layer for the second material layer.

Due to the folded cut-retardant material, the cutting blades of a cutter bar or of shears engaging the material are blocked; it is thus prevented that the protective element is cut through or separated. Since the surface area of the second material layer in the stretched-out state is 1.2 to 2.5 times greater than the surface area of the first material layer in the stretched-out state and since the second material layer is gathered or draped on the first material layer, the cut-retardant material is arranged wrinkled, folded, gathered or draped or the like within the protective element. Accordingly, the cut-retardant material is movable relative to the low-fold material so that the cut-retardant material is movable on the low-fold material layer and gripping or seizing of the second material layer is counteracted. A fabric layer which is lying underneath the second material layer is thus protected from being seized by the cutting blades.

Expediently, the surface area of the second material layer in the stretched-out state may be 1.4 to 1.7 times greater than the surface area of the first material layer in the stretched-out state. Since the surface area of the second material layer is greater than the surface area of the first material layer, it is ensured that the cutting teeth may engage the cut-retardant material but cannot pinch the low-fold material. In particular, the foldable cut-retardant material may also be laid in folds. In this way, a compact configuration of the protective element with the two flat material layers is ensured.

When the cutting blades engage the protective element, the cutting blades may grip the cut-retardant material but cannot cut through. Advantageously, the low-fold material does not change its position even when the cutting teeth cut into the cut-retardant material so that the gripped cut-retardant material moves on the low-fold material layer so that the cutting blades are prevented from cutting into the low-fold material. Accordingly, pinching or seizing of the low-fold material or of a fabric layer that is underneath this low-fold material is avoided.

The movement of the folded cut-retardant material relative to the first material layer is assisted when between the material layers a gliding layer is formed, wherein preferably the first material layer forms the gliding layer for the second material layer. Accordingly, the second material layer can glide relative to the first material layer. When the cutting blades of a hedge trimmer in operation contact the protective element, the cutting blades engage the cut-retardant material. Due to the cutting and pinching movement of the cutting teeth, the cut-retardant material is pinched. Since, due to the cutting movement of the cutting teeth, the cutting teeth move back and forth and the second material layer can glide relative to the first material layer, the cut-retardant material glides on the low-fold material. The low-fold material, on the other hand, maintain its low-fold shape. A pinching engagement of the cutting teeth in the low-fold material is prevented.

The first material layer is preferably connected with the second material layer at least at two fastening locations. Between the fastening locations advantageously a spacing is provided. In particular, the second material layer can glide relative to the first material layer in the areas between the fastening locations. In this way it is ensured that the two material layers are connected fixedly with each other so that, when cutting teeth that are in operation contact the protective element, the second material layer can glide relative to the first material layer but the two material layers remain connected to each other and substantially maintain their spatial position relative to each other. In particular, the second material layer remains disposed on the first material layer. In this way, a pinching engagement of the cutting teeth in the low-fold material is prevented. Accordingly, the protective element protects against a cutting action as well as a pinching action of the cutting teeth.

Expediently, the protective element comprises a device for holding the first material layer. The device is in particular designed to be shear-stiff. The device supports in this connection the first material layer such that the low-fold material is always low in folds, in particular stretched out and free of folds. Due to the material being maintained essentially free of folds, an engagement of the cutting teeth in operation into the low-fold material and thus a pinching engagement of the low-fold material is prevented. With a shear-stiff device a deformation, in particular bending of the device, is prevented so that the low-fold material has only minimal folds or is essentially free of folds. A pushing or shearing force acting on the device can be caused by the cutting teeth of the hedge trimmer as well as caused by the use of the protective element in the field. With the shear-stiff configuration of the device a change of the shape is substantially prevented even under these conditions.

Preferably, the device can be comprised of a frame, in particular a wire frame or a plastic frame that can be produced easily. The frame is easily adjustable with respect to shape.

In a further embodiment of the invention, the device for holding the first material layer is made of a spacer material. In this connection, in particular the first material layer is resting flat on the spacer material and can preferably be connected thereto. The spacer material supports in particular the low-fold material for maintaining the low-fold shape. A further advantageous function of the spacer material resides in that, when wearing the protective element, a spacing between the cut-retardant material and the skin of the user is provided in order to improve the wearing comfort. In particular, the spacer material is at least 3 mm thick. Accordingly, the spacing between the user and the cut-retardant material when wearing the protective element is at least 3 mm. Expediently, the spacer material is comprised of a knit spacer fabric or of foam material.

Advantageously, the spacer material is flexible, in particular elastically deformable. By means of the flexible spacer material as well as a flexible low-fold gliding layer material and a flexible cut-retardant material, the protective element as a whole is flexible and can therefore adjust to the body surface of the user when it is worn. At the same time, the spacer material provides a support layer for the low-fold material.

Preferably, the first material layer is connected fixedly with the device for holding the first material layer, in particular by being sewn, laminated, glued or the like. Shifting or slipping out of place of the first material layer is therefore reliably prevented. Due to the fixed connection of the first material layer with the device, wrinkling or even folding of the first material layer is effectively prevented also.

Advantageously, the first material layer has a smooth surface as a gliding surface. This assists in the second material layer performing a relative movement relative to the first material layer. Such a relative movement between the first material layer and the second material layer is particularly desired when in operation the moving cutting teeth of the hedge trimmer engage the protective element. Upon gliding of the second material layer on the first material layer, the first material layer remains substantially stretched (taut). Accordingly, the low-fold material remains low in folds (substantially free of folds) and pinching or even cutting of the cutting teeth into the first material layer is substantially prevented.

Advantageously, the protective element comprises an outer layer wherein in particular the outer layer is comprised of a cover material. When wearing the protective layer when working with a power tool, the protective element is exposed to environmental influences. For example, the protective element can be loaded with dirt or can become wet with water. An additional outer layer as a cover material provides an additional protection from environmental influences. The cover material is expediently water-repellent, dirt-repellent or the like. However, the cover material may in particular serve also only visual purposes.

The cover material is preferably fixedly connected with the first material layer, in particular laminated thereon, glued on, sewn on, or the like. The cover material is expediently fixedly connected along the edge with the first material layer 2, in particular, laminated on, glued on, sewn on or the like. Advantageously, the cut-retardant material is positioned between the cover material and the first material layer. In this way, the cut-retardant material is arranged so as to be always protected between the cover material and the first material layer.

At least one material is advantageously breathable. It is particularly advantageous when all of the material layers of the protective element are breathable. Due to the breathable material, the wearing comfort is improved. Even at high ambient temperatures, wearing of the protective element is comfortable.

At least one material is comprised advantageously of a textile material. In particular, all of the employed materials are made of textile material. Textile materials can be easily produced and shaped. Moreover, the wearing comfort of a protective element comprised of textile materials is high.

An insert intended for working with hand-guided power tools and provided with a protective action against seizing and cutting movements of shears, cutting blades or the like is advantageously provided with the protective element according to the invention. Such an insert can be integrated preferably into protective clothing (workwear). Expediently, the insert can also be secured by means of straps on a body part of the user. The inserts can vary in size. In an embodiment, the inserts are embodied to have a uniform size for users of different body shapes and sizes.

According to the invention, moreover protective clothing can be furnished with the protective element according to the invention in order to protect a user from the seizing and cutting movement of shears, cutting blades of a cutter bar or similar cutting tools. The protective clothing, in particular work pants, ensure that the covered body parts of the user are protected when wearing the protective clothing.

DESCRIPTION OF THE PREFERRED EMBODIMENTS

Figure 1:
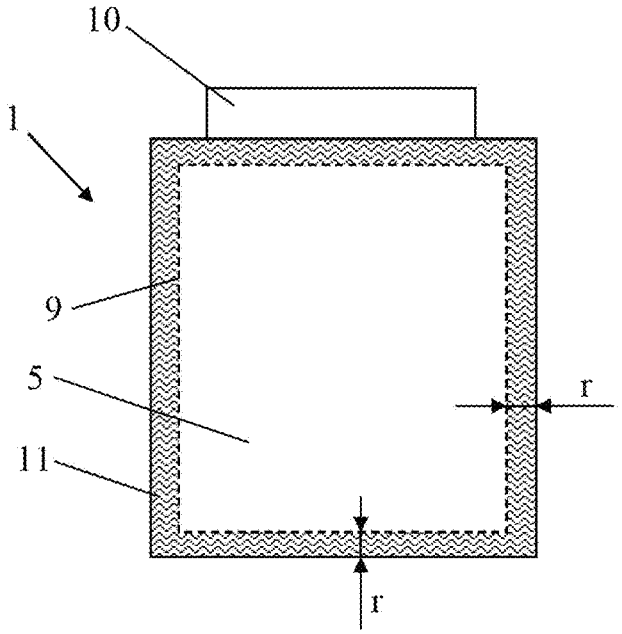
FIG. 1 shows a schematic illustration of a protective element.

FIG. 1 shows an exemplary embodiment of a protective element 1 according to the invention. In FIG. 1, the embodiment of the protective element 1 has a substantially rectangular contour. The shape of the protective element 1 depends on which body part of the user is to be protected and can deviate from the illustrated rectangular cross-sectional shape. The protective element 1 is comprised of several material layers that are resting flat on each other. The material layers are connected to each other by means of at least one fastening location 9. The fastening location 9 is a seam in the illustrated embodiment. The yarn which is used for the seam extends in the illustrated embodiment circumferentially at an edge spacing r that is in particular constant and amounts to approximately 1 cm relative to the outer boundary of the protective element 1. Expediently, on the outer edge of the protective element 1 a bordering tape 11 is arranged. The bordering tape 11 encloses all material layers laterally. The bordering tape 11 is fixedly connected by means of the fastening location 9 with the material layers.

A securing tab 10 is attached on the protective element 1. The securing tab 10 is attached by sewing in the shown embodiment. By means of the securing tab 10 the protective element 1 can be connected with workwear, not illustrated. For example, on the securing tab 10 a hook-and-loop fastener strap, not illustrated, can be attached which is connectable to the workwear. Also, the securing tab 10 can be sewn onto the workwear so that a permanent connection between the protective element 1 and the workwear is provided.

Figure 2:
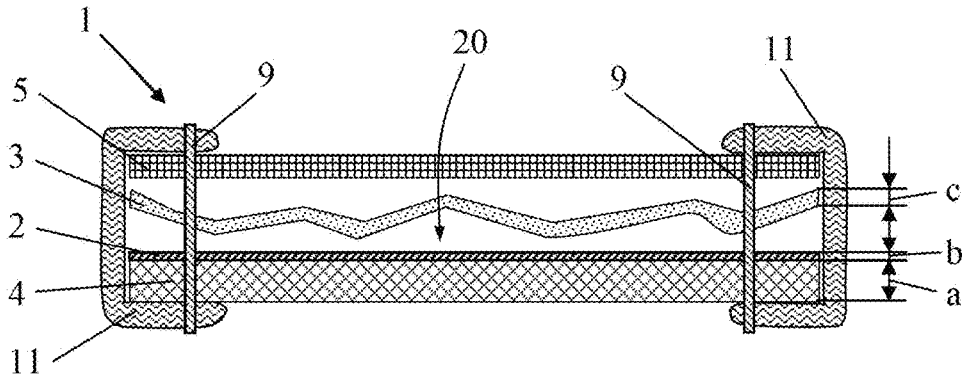
FIG. 2 is a schematic cross-sectional illustration of the protective element with a first material layer and a second material layer.

FIG. 2 shows schematically a cross-section of the protective element 1. The material layers of the protective element 1 are resting flat on each other. In the embodiment according to FIG. 2, a first material layer 2 is directly adjacent to a second material layer 3. The first material layer 2 is supported by a device 4. In the embodiment, the device 4 is designed as a further flat material layer wherein the first material layer 2 is positioned between the device 4 and the second material layer 3. When wearing the protective element 1, the device 4 and the first material layer 2 are facing the body, the second material layer 3 is facing away from the body. An outer layer 5 is arranged on the side of the second material layer 3 which is facing away from the first material layer 2. The outer layer 5 also forms a further flat material layer. In the embodiment, the protective element 1 is comprised of four stacked flat material layers. The lateral boundaries of the material layers are engaged by the bordering tape 11 that extends circumferentially. The first material layer 2, the second material layer 3, the device 4, the outer layer 5 as well as the bordering tape 11 are fixedly connected to each other by the fastening locations 9; in the embodiment, the layers 2, 3, 4, 5, 11 are sewn together.

The first material layer 2 is comprised of a low-fold material. The low-fold material is preferably designed as a gliding material and forms a gliding layer 20. The gliding material is provided so that the second material layer 3 can glide on the first material layer 2. The first material layer 2 is held in a stretched-out (taut) state by the device 4. In the illustrated embodiment, the first material layer 2 is resting flat on the device 4 and is connected at the fastening locations 9 to the device 4. Expediently, the first material layer 2 can also be connected across its surface area with the device 4, for example, glued on or laminated on. Advantageously, the surface of the device 4 and the gliding material of the first material layer 2 are embodied as a one-part configuration. It is important in this context that the second material layer 3 is movable relative to the first material layer 2, in particular is able to glide on the first material layer 2.

The device 4 in the illustrated embodiment is embodied as a spacer material with a spacer material thickness a of 5 mm. The spacer material is bendable or flexible and shape-stable. The thickness b of the first material layer 2 with the gliding layer 20 is less than 0.2 mm. The spacer material thickness a is thus significantly greater than the thickness b of the first material layer 2.

The second material layer 3 is comprised of a cut-retardant material, for example, felt, with a cut-retardant material thickness c of 2 mm. In the stretched-out state, i.e., the not yet sewn-together state of the material layers, the flat stretched-out surface area of the second material layer 3 is greater than the flat stretched-out surface area of the first material layer 2. In order to be able to place the second material layer 3 congruently onto the first material layer 2, the second material layer 3 is placed in a gathered state onto the first material layer 2. Subsequently, the two material layers 2 and 3 are connected to each other at the fastening locations 9. Due to the gathered state, the cut-retardant material is laid in a crumpled, wrinkled, gathered together, folded or similar arrangement in the protective element 1. The inserted cut-retardant material is lying flat on the gliding material or on the gliding layer 20.

Outside of the fastening locations 9, the cut-retardant material is provided relative to the gliding material with movement possibilities in all spatial directions, in particular in the directions parallel to the surface of the first material layer 2. Since the first material layer 2 is configured as a taut, smooth material, the second material layer 3 can glide unhindered on the first material layer 2 so that the freedom of movement of the cut-retardant material is enhanced.

The outer layer 5 of the protective element serves as a cover material. The outer layer 5 protects the protective element from environmental influences such as water, dirt or the like. The cover material may serve however only visual purposes.

Figure 3:
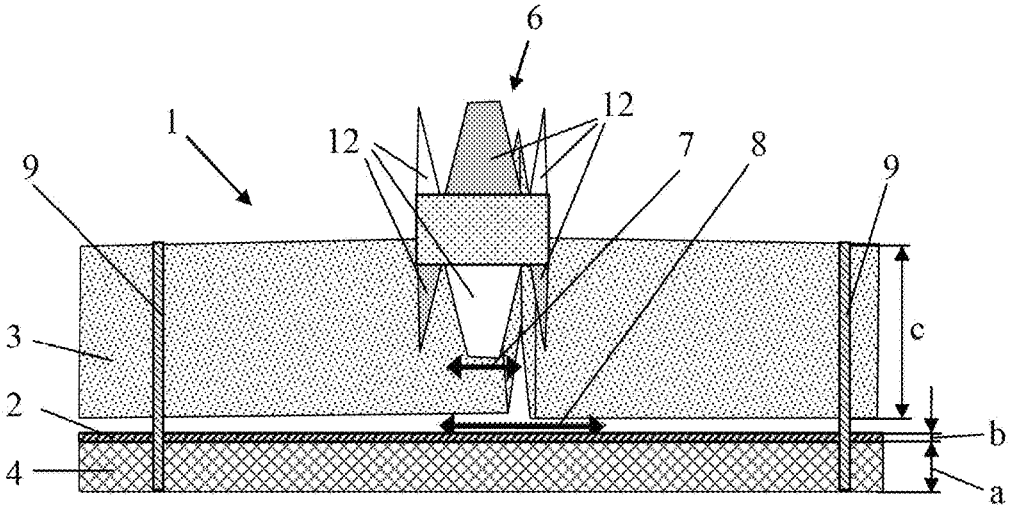
FIG. 3 is a schematic transverse section illustration of the protective element with cutting teeth engaging the protective element.

With the aid of FIG. 3, the function of the protective element 1 when acted on by a tool 6 will be explained. In the embodiment, the tool 6 is comprised of cutting teeth 12 of a hedge trimmer. The cutting teeth 12 of a hedge trimmer in operation are moved back and forth across each other so that two cutting blades perform a cutting movement with each other. Such a cutting movement is performed also between the blades of garden shears or anvil shears.

When the cutting teeth 12 engage or seize the protective element 1, the cutting teeth 12 grip the cut-retardant material of the second material layer 3 together with the outer layer 5. The cut-retardant material blocks the further movement of the cutting teeth 12; the second material layer 3 is thus essentially not separated or cut through. The cut-retardant material prevents that the cutting teeth 12 cut through the second material layer 3. However, the cutting teeth 12 can cause a surficial cut in the cut-retardant material.

Due to the closing movement of two cutting teeth 12, the cut-retardant material is pulled into the tool 6. The first material layer 2 continues to be stretched by the device 4 so that the first material layer 2 cannot be gripped by the cutting teeth 12. Due to the larger surface area of the second material layer 3 in comparison to that of the first material layer 2, it is ensured that the tool 6 grips only the cut-retardant material and, due to the relative movement of the material layers relative to each other, the first material layer 2 is not gripped by the tool.

Upon reciprocating movement 7 of the cutting teeth 12, the second material layer 3 glides back and forth on the first material layer 2, for example, in a gliding movement 8. Due to the gliding action of the cut-retardant material on the gliding layer 20 of the gliding material, the cutting teeth 12 pinch and seize the cut-retardant material itself but cannot grip the first material layer 2. Accordingly, cutting as well as pinching of the first material layer 2 by the cutting teeth 12 is substantially prevented.

Figure 4:
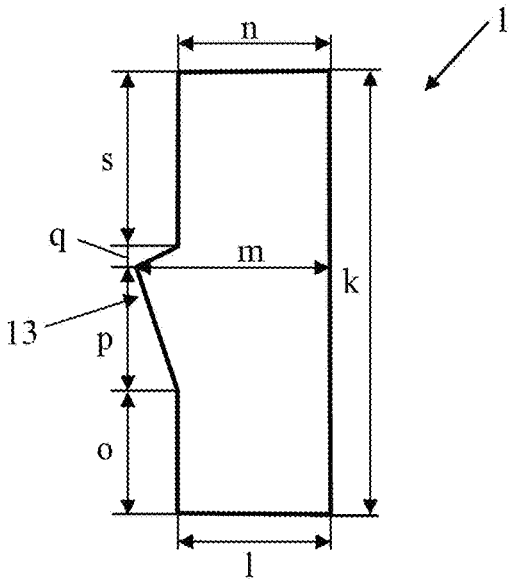
FIG. 4 is a further schematic illustration of a protective element.

In FIG. 4, a schematic dimensional illustration of a further geometry of the protective element 1 is shown that deviates from that of FIG. 1. The tailored part of the protective element 1 has a maximum length k and a maximum width m so that, upon wearing the protective element on the leg, the protective element at least partially will cover the thigh and the knee. The tailored part of the protective element 1 has a lower width l. Moreover, the protective element 1 has an upper width n that is identical to the lower width l. Across a lower length o the lower width l is constant. Subsequently, the width of the protective element 1 increases linearly to a maximum width m across a length p. Across the length q the maximum width m linearly decreases to the upper width n. Subsequently, the width of the protective element 1 across an upper length s is constant and corresponds to upper width n. The lengths o, p, q, s are orthogonal to the widths l, m, n.

In the embodiment, the projection 13 formed as a result of the maximum width m is arranged only on one side of the protective element 1. When wearing the protective element 1 on the leg, the projection 13, for example, can cover a part of the inner side of the thigh. Also, with at least one cutout can be provided in the protective element 1. The cutout enables spatial curving or bending of the protective element 1. Such a curvature can be required, for example, when the protective element 1 is to be pulled across the knee, elbow or similar body part of the user.

Figure 5:
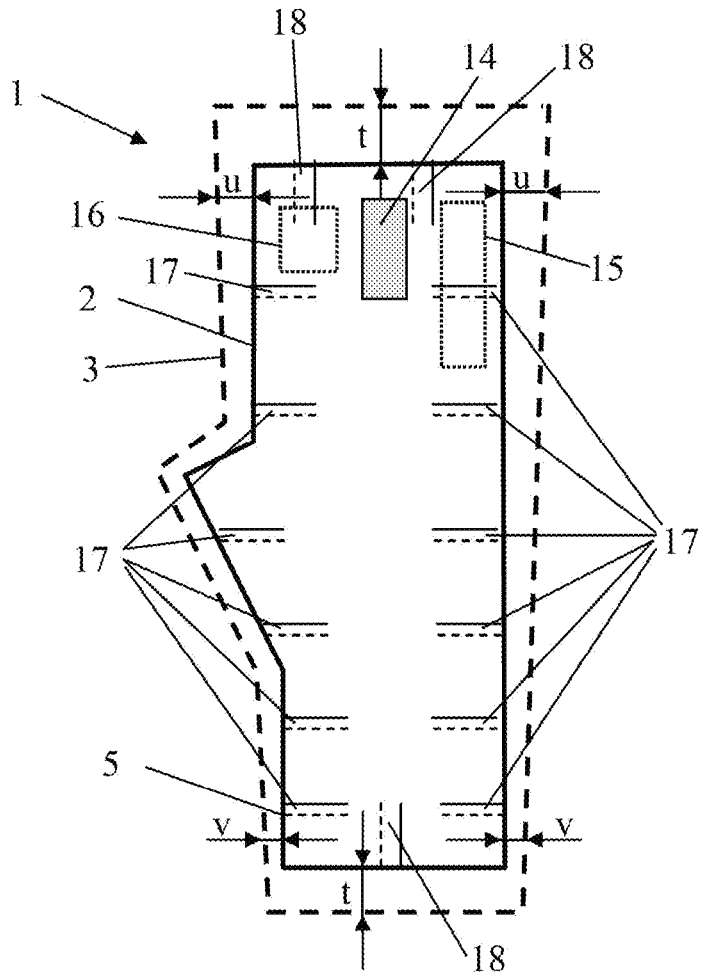
FIG. 5 is a schematic illustration of the first and second material layers resting on each other in the stretched-out state.

FIG. 5 shows the cutting patterns for the first material layer 2 and the second material layer 3. The dimensions of the first material layer 2 correspond in the illustration of FIG. 4 to the tailored part of the protective element 1.

The second material layer 3 in the area of the lower width l (FIG. 4) is longer by an overlap length t. The second material layer 3 is also longer in the area of the upper width n (FIG. 4) by the overlap length t. Laterally, in the area of the lower width l (FIG. 4), the second material layer 3 is on both sides wider by a lower lateral overlap length v than the first material layer 2. Laterally, in the area of the upper width n (FIG. 4), the second material layer 3 is on both sides wider by an upper overlap length u than the first material layer 2. In this way, the surface area of the second material layer 3 in the stretched-out state illustrated in FIG. 5 is greater than the surface area of the first material layer 2.

In an embodiment of the invention, the surface area of the second material layer 3 in the stretched-out state is approximately 1.2 to 2.5 times greater, in particular approximately 1.4 to 1.9 times greater, than the surface area of the first material layer 2 in the stretched-out state.

In order to be able to place the first material layer 2 as well as the second material layer 3 congruently onto each other, the second material layer 3 is gathered together on the first material layer 2. For this purpose, several horizontal folds 17 as well as vertical folds 18 are provided in the second material layer 3 along the outer boundary of the first material layer 2. In the embodiment according to FIG. 5, twelve horizontal folds 17 are provided, six horizontal folds 17 each on either side. The horizontal folds 17 are approximately equidistantly arranged. In the embodiment according to FIG. 5, a vertical fold 18 is arranged centrally in the lower area of the lower width l and two vertical folds 18 are arranged equidistantly spaced in the area of the upper width n.

The folds 17, 18 are secured by means of the fastening location 9 (FIG. 1), for example, by sewing. In the area outside of the fixedly sewn-in folds 17, 18, the orientation of the cut-retardant material is not defined. The cut-retardant material can arrange itself freely, for example, can wrinkle, form folds or the like.

Further elements can be sewn onto the outer layer 5, which in FIG. 5 is congruent with the first material layer 2. Such elements can be, for example, an adhesive part 14, an information carrier 15, a warning sign 16 or the like. In the embodiment, an adhesive part 14 is centrally arranged below the outer edge in the area of the upper width n (FIG. 4). On the adhesive part 14 a hook-and-loop fastener, not illustrated, is attached. In the embodiment, on the information carrier 15 the manufacturer name can be provided as well as a manufacturer's acronym, an article number or the like. On the warning sign 16, the logo of a hedge trimmer can be shown in order to indicate the purpose of use of the protective element 1.

The elements 14, 15, 16 can also be sewn onto the device 4.

In the embodiment, the fastening location 9 is made of a yarn with polyester. The first material layer 2 comprises polyamide. The second material layer 3 is comprised, for example, of felt, of a textile flat material with DYNEEMA™, of a textile flat material with KEVLAR™, or other comparable cut-retardant material. In the embodiment, the device 4 is comprised of a spacer material with polyester. The outer layer 5 is produced as a top cloth with polyester. The bordering tape 11 is made of synthetic or natural fibers.

All material layers are breathable. The protective element 1 is thus kind to the skin and comfortable when worn.

An insert, not illustrated, comprises the protective element 1. The insert can be, for example, inserted into protective workwear. The insert can also be provided with fastening means, for example, ties, rubber straps (elastic straps), or the like in order to secure the insert on a body part of the user.

Protective clothing, not illustrated, is comprised at least partially of a protective element 1. Such protective clothing can be, for example, in the form of work pants wherein the protective element 1 is arranged in the area of the thigh and the knee.

The specification incorporates by reference the entire disclosure of European priority document 13 004 295.5 having a filing date of Aug. 30, 2013.

While specific embodiments of the invention have been shown and described in detail to illustrate the inventive principles, it will be understood that the invention may be embodied otherwise without departing from such principles.

What is claimed is:

1. A protective element comprising:

a flat first material layer comprised of a low-fold material and forming a supporting layer;

a flat second material layer comprised of a folded cut-retardant material;

wherein a surface area of the second material layer in a stretched-out state is 1.2 to 2.5 times greater than a surface area of the first material layer in a stretched-out state;

wherein the second material layer is placed in a gathered state onto the first material layer;

wherein the first material layer forms a gliding layer for the second material layer such that the folded cut-retardant material of the second material layer is moveable on the low-fold material of the first material layer and, by moving relative to the first material layer when engaged by cutting blades that are moving relative to each other, prevents that the first material layer arranged underneath the second material layer is gripped or pinched by the cutting blades.

2. The protective element according to claim 1, wherein the surface area of the second material layer in the stretched-out state is 1.4 to 1.7 times greater than the surface area of the first material layer in the stretched-out state.

3. The protective element according to claim 1, wherein the first material layer is connected with the second material layer at least at two fastening locations and wherein the fastening locations are spaced apart.

4. The protective element according to claim 1, further comprising an outer layer wherein the outer layer is comprised of a cover material.

5. The protective element according to claim 4, wherein the cover material is fixedly connected with the first material layer.

6. The protective element according to claim 5, wherein the cover material is laminated, glued or sewn onto the first material layer.

7. The protective element according to claim 4, wherein an edge of the cover material is fixedly connected to an edge of the first material layer.

8. The protective element according to claim 7, wherein the cover material is laminated, glued or sewn onto the first material layer.

9. The protective element according to claim 1, wherein at least one of the first and second material layers is made of a breathable material.

10. The protective element according to claim 1, wherein at least one of the first and second material layers is comprised of a textile material.

11. An insert with a protective element of claim 1.

12. Protective clothing comprised at least partially of a protective element of claim 1.

13. The protective element according to claim 1, wherein the folded cut-retardant material layer is comprised of a felt.

14. A protective element comprising:

a flat first material layer comprised of a low-fold material;

a flat second material layer comprised of a folded cut-retardant material;

wherein a surface area of the second material layer in a stretched-out state is 1.2 to 2.5 times greater than a surface area of the first material layer in a stretched-out state;

wherein the second material layer is placed in a gathered state onto the first material layer;

wherein the first material layer forms a gliding layer for the second material layer;

a device for holding the first material layer, wherein the device is shear-stiff.

15. The protective element according to claim 14, wherein the device is comprised of a frame.

16. The protective element according to claim 15, wherein the frame is comprised of a wire frame or a plastic frame.

17. The protective element according to claim 14, wherein the device is comprised of a spacer material.

18. The protective element according to claim 17, wherein the spacer material has a thickness of at least three millimeter.

19. The protective element according to claim 17, wherein the spacer material is flexible.

20. The protective element according to claim 14, wherein the first material layer is fixedly connected with the device.

21. The protective element according to claim 20, wherein the first material layer is connected to the device by sewing, by laminating or by gluing.

22. A protective element as a cutting protection for a power tool comprising reciprocating blades that are moving reciprocatingly relative to each other, the protective element comprising:

a flat first material layer comprised of a low-fold material and forming a supporting layer;

a flat second material layer comprised of a folded cut-retardant material;

wherein a surface area of the second material layer in a stretched-out state is 1.2 to 2.5 times greater than a surface area of the first material layer in a stretched-out state;

wherein the second material layer is placed in a gathered state onto the first material layer;

an outer layer comprised of a cover material, wherein the second material layer is covered by the cover material of the outer layer and wherein the cover material is fixedly connected with the low-fold material of the first material layer;

wherein the first material layer comprised of the low-fold material forms a gliding layer for the second material layer comprised of the folded cut-retardant material such that, when reciprocating blades engage the protective element, the outer layer and the second material layer comprised of the folded cut-retardant material are engaged by the reciprocating blades and cutting into the first material layer is prevented by the second material layer gliding on the first material layer.

* * * * *